US009936768B2

(12) United States Patent
Girard et al.

(10) Patent No.: US 9,936,768 B2
(45) Date of Patent: Apr. 10, 2018

(54) FOOTWEAR ELEMENT

(71) Applicant: SALOMON S.A.S., Metz-Tessy (FR)

(72) Inventors: Francois Girard, Veyrier du Lac (FR); Aude Derrier, Viviers du Lac (FR)

(73) Assignee: SALOMON S.A.S., Metz-Tessy (FR)

( * ) Notice: Subject to any disclaimer, the term of this patent is extended or adjusted under 35 U.S.C. 154(b) by 494 days.

(21) Appl. No.: 13/857,463

(22) Filed: Apr. 5, 2013

(65) Prior Publication Data

US 2013/0263477 A1 Oct. 10, 2013

(30) Foreign Application Priority Data

Apr. 6, 2012 (FR) ..... 12 01048

(51) Int. Cl.

| | |
|---|---|
| ***A43C 15/02*** | (2006.01) |
| ***A43B 5/18*** | (2006.01) |
| ***A43C 11/12*** | (2006.01) |
| ***A43C 11/14*** | (2006.01) |
| ***A43C 15/06*** | (2006.01) |

(52) U.S. Cl.

CPC ..... *A43C 15/02* (2013.01); *A43B 5/18* (2013.01); *A43C 11/12* (2013.01); *A43C 11/14* (2013.01); *A43C 15/063* (2013.01); *A43C 15/066* (2013.01); *A43C 15/068* (2013.01)

(58) Field of Classification Search

CPC ..... A43C 15/02; A43C 15/068; A43C 15/063; A43C 15/066; A43C 11/12; A43C 11/14; A43C 15/12; A43C 15/14; A43B 5/18

USPC ..... 36/134, 7.7, 7.6, 59 R

See application file for complete search history.

(56) References Cited

U.S. PATENT DOCUMENTS

| | | | | | |
|---|---|---|---|---|---|
| 997,055 | A | * | 7/1911 | Gilowitz | A43C 15/08 36/134 |
| 1,964,442 | A | * | 6/1934 | Roche | A43C 15/06 36/62 |
| 3,229,389 | A | | 1/1966 | Adams | |
| 3,685,173 | A | * | 8/1972 | Piazza | A43C 15/068 36/64 |
| 4,353,172 | A | * | 10/1982 | Bryant | A43C 15/068 36/62 |
| 4,745,692 | A | * | 5/1988 | Liao | A43C 15/02 36/61 |
| 4,788,780 | A | * | 12/1988 | Boggs | A43B 3/16 36/117.2 |
| D368,361 | S | * | 4/1996 | Brooks | D2/912 |
| 5,600,901 | A | | 2/1997 | Leonor | |

(Continued)

FOREIGN PATENT DOCUMENTS

| | | |
|---|---|---|
| EP | 1 166 673 A1 | 1/2002 |
| EP | 1 808 088 A1 | 7/2007 |

*Primary Examiner* — Jila M Mohandesi

(74) *Attorney, Agent, or Firm* — Greenblum & Bernstein, P.L.C.

(57) ABSTRACT

A footwear element that includes an outer sole assembly and a flexible upper, as well as spikes projecting in the area of an outer surface of the outer sole assembly, the flexible upper including a lower portion adapted to cover the foot of a user, the flexible upper having a shoe insertion opening. The upper includes an upper portion extending the lower portion in a direction away from the outer sole assembly, the upper portion being provided to cover at least the ankle of the user, or the ankle and a portion of the lower leg.

28 Claims, 8 Drawing Sheets

(56) References Cited

U.S. PATENT DOCUMENTS

| | | | | |
|---|---|---|---|---|
| 5,689,901 | A * | 11/1997 | Bell | A43C 15/06 36/135 |
| 6,360,455 | B1 * | 3/2002 | Seo | A43C 15/14 36/134 |
| 6,481,121 | B1 * | 11/2002 | Tucker | A43B 13/26 36/15 |
| 6,675,504 | B1 * | 1/2004 | Biancucci | A43C 15/08 36/59 R |
| 7,836,610 | B2 * | 11/2010 | Laporte | A43C 15/08 36/62 |
| 8,876,123 | B2 * | 11/2014 | Bradshaw | A63C 1/04 280/11.3 |
| 2002/0178611 | A1 * | 12/2002 | Farys | A43B 5/002 36/7.6 |
| 2002/0189133 | A1 * | 12/2002 | Parisotto | A43C 15/061 36/7.6 |
| 2006/0021254 | A1 | 2/2006 | Jones | |
| 2008/0010865 | A1 | 1/2008 | Giovale et al. | |
| 2008/0022560 | A1 * | 1/2008 | Grimmeisen | A43C 15/02 36/114 |
| 2010/0077635 | A1 | 4/2010 | Baucom et al. | |
| 2010/0192417 | A1 | 8/2010 | Baucom et al. | |
| 2011/0113653 | A1 * | 5/2011 | Grimmeisen | A43B 3/246 36/134 |
| 2011/0296711 | A1 * | 12/2011 | Nelson | A43B 5/18 36/103 |
| 2012/0055046 | A1 | 3/2012 | Baucom et al. | |
| 2012/0066939 | A1 * | 3/2012 | Codega | A43C 15/063 36/59 C |
| 2013/0014409 | A1 * | 1/2013 | Chouinard | A43B 5/08 36/59 R |

* cited by examiner

FOOTWEAR ELEMENT

CROSS-REFERENCE TO RELATED ED APPLICATION

This application is based upon French Patent Application No. 12/01048, filed Apr. 6, 2012, the disclosure of which is hereby incorporated by reference thereto in its entirety, and the priority of which is claimed under 35 U.S.C. § 119.

BACKGROUND

1. Field of the Invention

The present invention relates to a footwear element comprising an outer sole assembly and a flexible upper, as well as spikes projecting in the area of an outer surface of the outer sole assembly. The footwear element is used to house an article of footwear, such as a sports boot or shoe. The invention also relates to an assembly comprising the shoe/boot and the footwear element.

The footwear element and the shoe/boot can be used in fields such as walking or running on flat or mountainous terrain, hiking, or climbing.

2. Background Information

The shoe itself is known. It includes an outer sole assembly and a flexible upper, thereby enabling a user to walk, run, or practice a sport under normal conditions, whether on dry terrain, or on moist, wet, or even snowy or muddy terrain. It becomes difficult, even dangerous, to walk, run, or practice a sport when the terrain is degraded or is naturally difficult. This is particularly the case when the ground is slippery due, for example, to mud, snow, ice, or the like. To deal with situations such as those mentioned above, it is known to cover the shoe with a footwear element, which is precisely adapted to make it easier to walk, run, or practice a sport on difficult terrain.

According to U.S. Pat. No. 5,600,901, for example, a footwear element comprises an outer sole assembly and a flexible upper, as well as spikes projecting in the area of an outer surface of the outer sole assembly. The flexible upper of the footwear element includes a lower portion adapted to cover the shoe. It is observed, according to U.S. Pat. No. 5,600,901, that the flexible upper of the footwear element has an insertion opening enabling it to be positioned on the shoe. The footwear element, via the spikes attached thereto, enables the user to walk or play golf on degraded or naturally difficult terrain. However, the use of a footwear element according to U.S. Pat. No. 5,600,901 is not always completely satisfactory, and is limited to walking.

Indeed, although the spikes make it easier to walk, run, or play sports with regard to the grip on the ground, accuracy of the supports, or the transmission of sensory information, the wearer is still hampered under extreme conditions. This is the case on very wet terrain, whereby water infiltrates the footwear element and the shoe. This is also the case in snow or on icy terrain, whereby snow or ice crystals penetrate into the footwear element and the shoe, or snow or ice cover the ankle or the lower leg. In fact, the user is not protected against the intrusion of foreign material, or against thermal attacks, especially against cold weather, in the area of the ankle and of the lower leg.

SUMMARY

In view of the foregoing, the invention generally improves a footwear element fitted with spikes. More specifically, the invention reduces, or even eliminates the discomfort caused by water, snow or ice, as well as the discomfort resulting from difficult thermal conditions, especially the cold. In other words, the invention improves the comfort of the footwear element. Furthermore, the invention improves the grip on the ground, the accuracy of supporting forces applied to the ground, and the transmission of sensory information to the foot.

To this end, the invention provides a footwear element comprising an outer sole assembly and a flexible upper, as well as spikes projecting in the area of an outer surface of the outer sole assembly, the flexible upper comprising a lower portion adapted to cover the foot of a wearer, the flexible upper having a shoe/boot insertion opening.

The upper of the footwear element according to the invention comprises an upper portion extending the lower portion in a direction away from the outer sole assembly, the upper portion being adapted to cover at least the ankle of the user, or the ankle and a portion of the lower leg.

The upper portion of the upper increases the outer surface of the footwear element, as compared to an element according to the prior art. The upper portion of the upper can also be said to increase the fitting and protection volume offered by the footwear element according to the invention. Accordingly, the specific properties of the lower portion of the upper, such as water tightness or thermal insulation, are extended to the upper portion. This means that in addition to the foot, the ankle, or the ankle and a portion of the lower leg assembly are protected. This improves the footwear element. Water, snow, or ice can no longer penetrate, or easily penetrate, inside the footwear element. The shoe/boot and the foot are therefore safeguarded against the intrusion of foreign material, or against thermal attacks, especially against cold weather, in the area of the ankle and of the lower leg. The improved foot and ankle wrapping further makes it possible to increase the proprioceptive perceptions, and therefore to improve the stability of the wearer.

As will be understood from the following description, the upper portion of the footwear element also reinforces the retention of its outer sole assembly against the outer sole assembly of the shoe/boot. This advantageously results in a greater stability of the spikes, and thus a better grip on the ground, as well as a greater precision of the supports or of the transmission of sensory information.

BRIEF DESCRIPTION OF DRAWINGS

Other characteristics and advantages of the invention will better understood from the description that follows, with reference to the annexed drawings illustrating, by way of non-limiting embodiments, how the invention can be embodied, and in which.

DETAILED DESCRIPTION

The first embodiment described below relates more specifically to a footwear element for walking or running on snow or ice, or for climbing in ice cascades. However, the invention is also applicable to other fields, such as those mentioned above.

The first embodiment is described below with reference to FIGS. 1 to 4.

Figure 1:
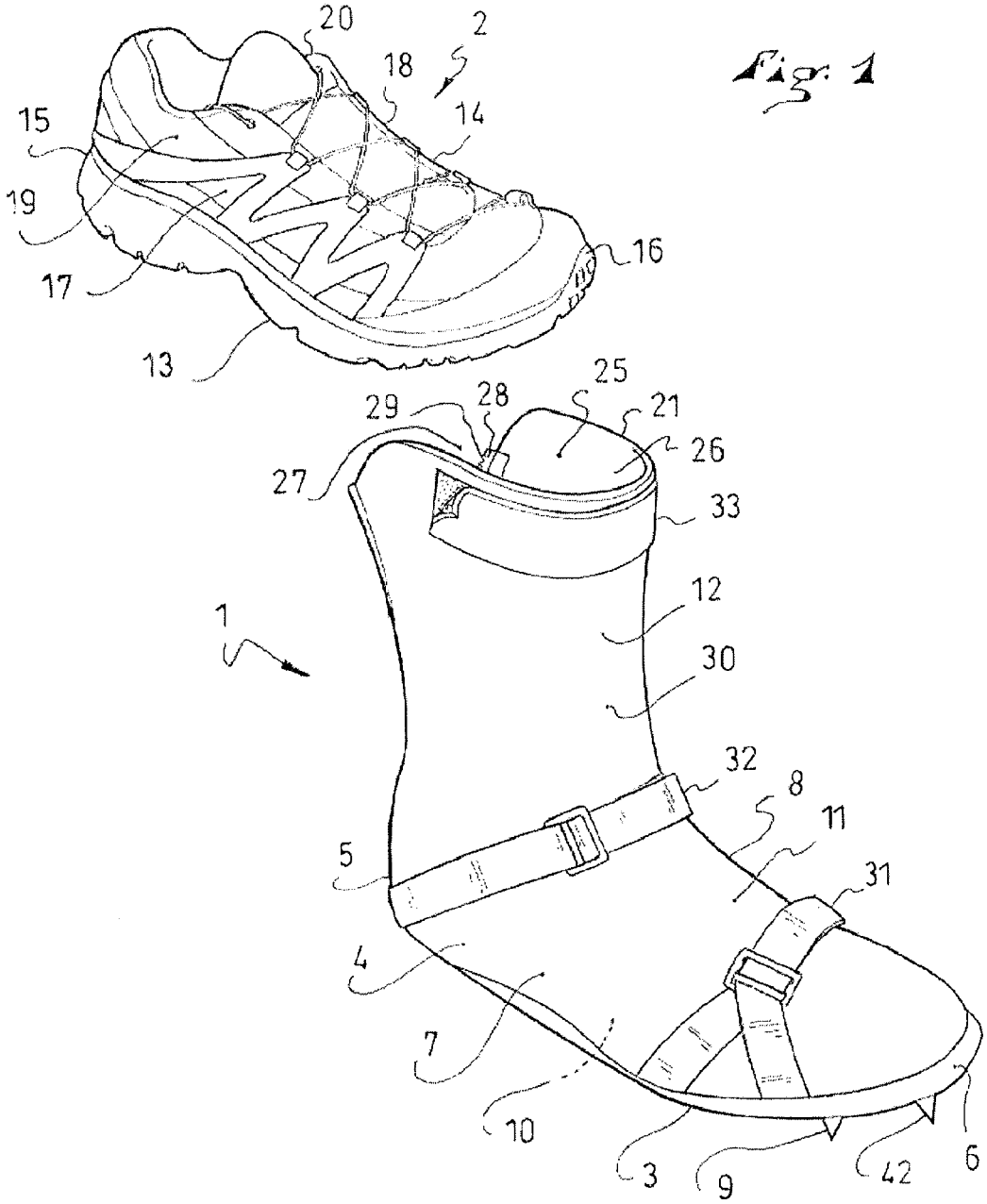
FIG. 1 is a front perspective view of an assembly including a footwear element and a shoe or boot according to a first embodiment of the invention, in a case in which the footwear element and the shoe/boot are separated from one another.

As shown in FIG. 1, a footwear element 1 is adapted to receive a walking or running shoe 2, itself adapted to receive the foot of the user, or wearer.

Conventionally, the footwear element 1 comprises an outer sole assembly 3 and a flexible upper 4. The footwear element extends lengthwise from a rear end 5, or heel, to a front end 6, or tip, and widthwise between a lateral portion 7 and a medial portion 8.

The footwear element 1 also comprises spikes 9 projecting from the area of an outer surface 10 of the outer sole assembly 3. The positioning of the spikes 9 is described in detail below, although it can be said here that each spike 9 is used to improve the grip of the footwear element 1 on a slippery ground, covered with snow or ice.

As shown, the upper 4 comprises a first portion, or lower portion 11, provided to surround the foot via the shoe 2.

According to the invention, the upper 4 of the footwear element 1 comprises an upper portion 12 extending the lower portion 11 in a direction away from the outer sole assembly 3, the upper portion 12 being provided to cover at least the ankle of the user, or the ankle and a portion of the lower leg.

The upper portion 12 of the upper 4 increases the outer surface of the footwear element 1, compared to an element whose upper would only comprise a lower portion. In fact, the upper portion 12 of the upper 4 also increases the fitting and protection volume of the footwear element. Accordingly, the specific properties of the lower portion 11 of the upper, such as water- or snow-proofness, or thermal insulation, are extended by the upper portion 12. In the end, the foot, the ankle, and a portion of the lower leg are protected at the same time. Water, snow, or ice can hardly penetrate, if at all, inside the footwear element 1. The shoe 2 is therefore also protected.

The shoe 2 comprises an outer sole assembly 13 and a flexible upper 14. The shoe 2 extends lengthwise from a rear end 15, or heel, to a front end 16, or tip, and widthwise between a lateral portion 17 and a medial portion 18. According to the first embodiment described, the shoe 2 comprises a lower portion 19 and no upper portion. The shoe 2 extends height-wise from the outer sole assembly 13 to an upper end 20, that is to say, up to the free end of the lower portion 19 or of the upper 14. Similarly, the footwear element 1 extends height-wise from the outer sole assembly 3 to an upper end 21, that is to say, up to the free end of the upper portion 12 or of the upper 4. Thus, when the shoe 2 is positioned in the footwear element 1, the upper end 20 of the upper 14 is closer to the outer sole assembly 3 than the upper end 21. This reflects the fact that the upper 4 of the footwear element 1 extends the coverage achieved by the upper 14 of the shoe 2.

Figure 2:
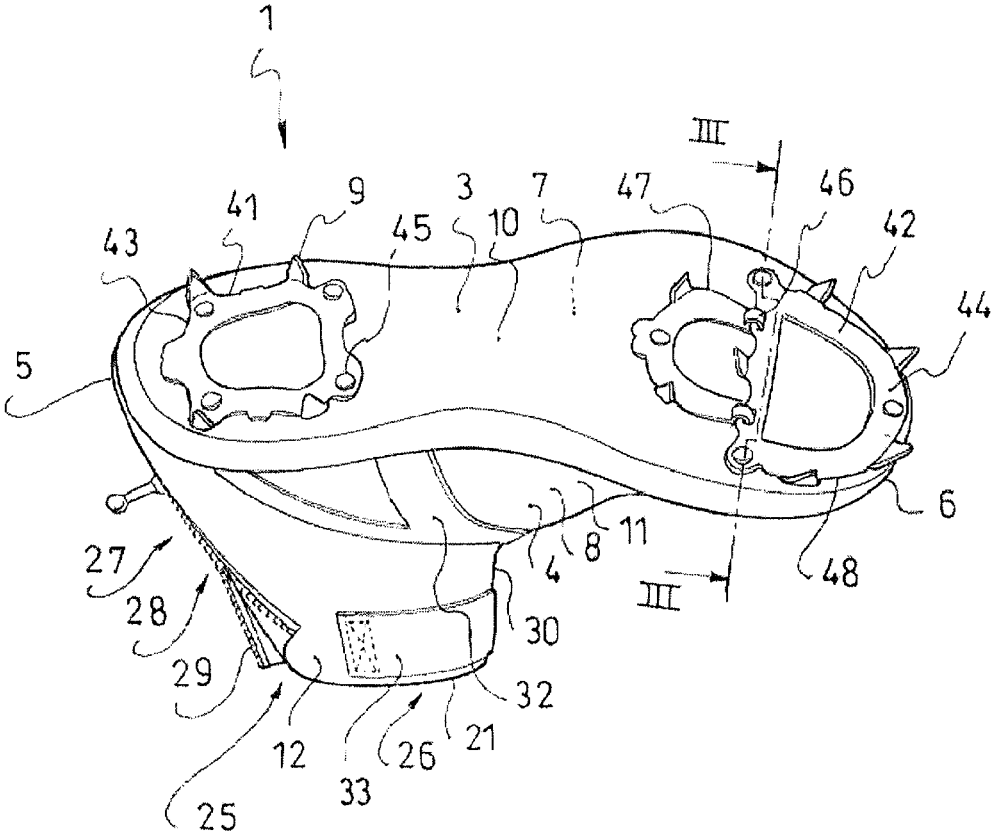
FIG. 2 is a perspective bottom view of the footwear element of FIG. 1.
Figure 3:
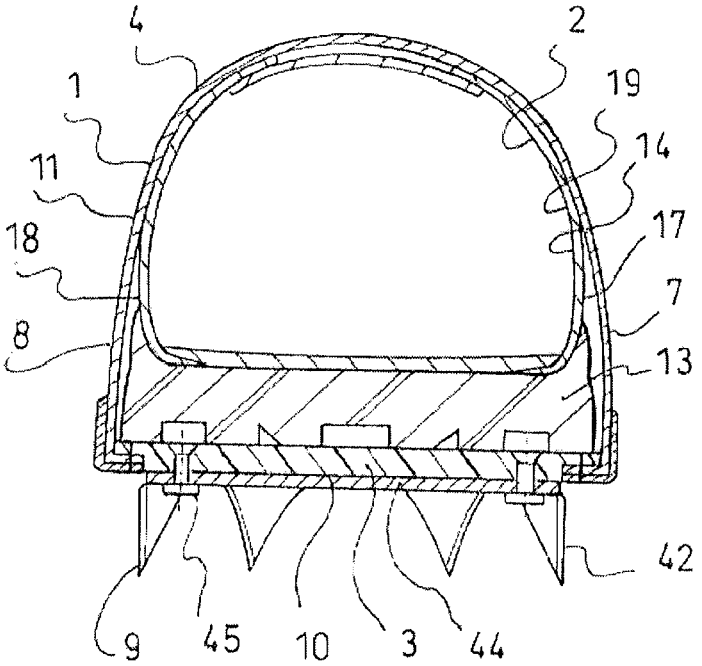
FIG. 3 is a cross-section along the line III-III of FIG. 2.
Figure 4:
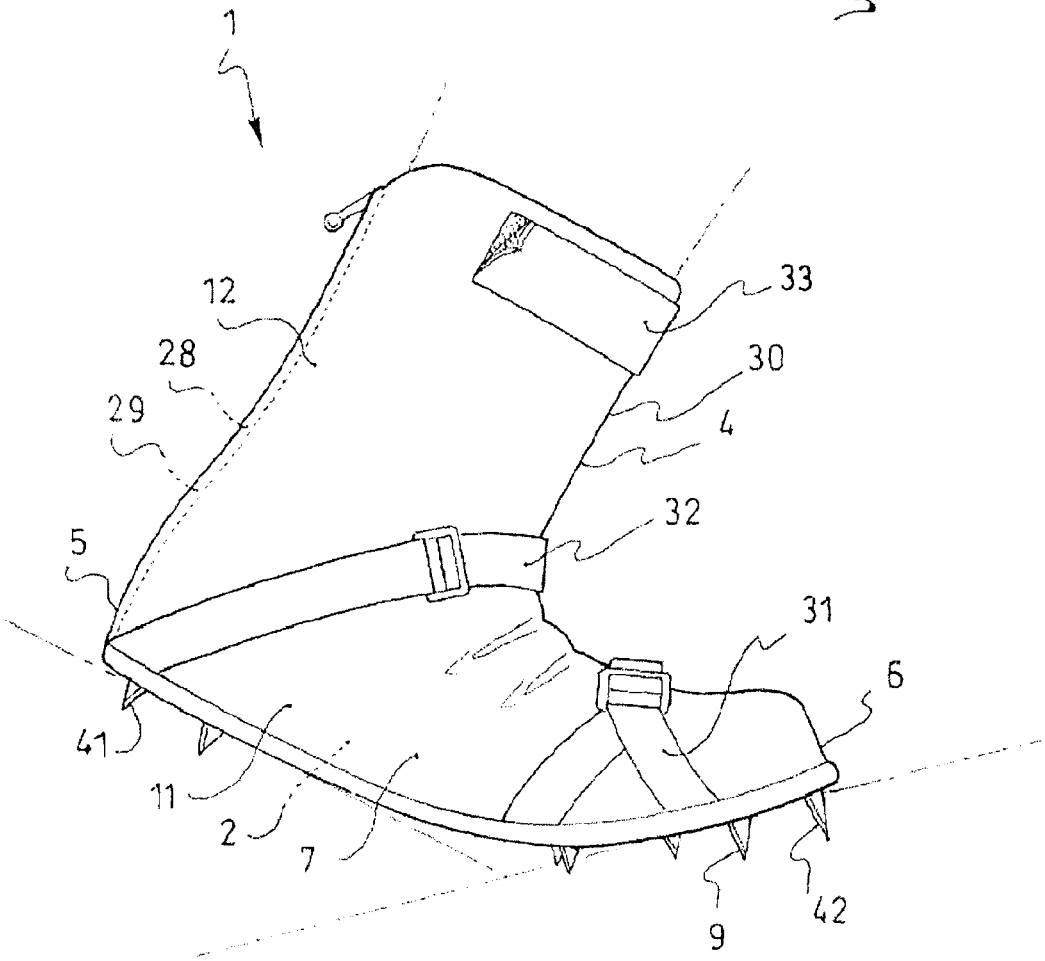
FIG. 4 is a side view of the footwear element in a case in which it houses the shoe/boot, still according to the first embodiment, in a bent/flexed state.

Still according to the first embodiment of the invention, as shown in FIGS. 1, 2, and 4, the lower portion 11 and upper portion 12 of the footwear element 1 form a continuous envelope. This means that no passage is provided to allow foreign material therethrough. This also means that the protection afforded by the flexible upper 4 extends to the area of the lower portion 11 and to the area of the upper portion 12.

Considering FIGS. 1 and 2 more specifically, the footwear element 1 has a shoe insertion opening 25, which extends from the upper end 21 to the rear end 5, in the area of the outer sole assembly 3. On the side of the upper end 21, the opening 25 has an upper subdivision 26 adapted to allow the foot therethrough, and also to surround the lower leg after shoe insertion. In the area of the rear of the lower leg and of the heel, between the upper end 21 and the rear end 5, in the area of the outer sole assembly 3, the shoe insertion opening 25 of the flexible upper 4 has a lower subdivision 27 which makes it possible to vary the size of the shoe insertion opening and of the fitting volume. The upper 26 and lower 27 subdivisions are co-extensive. This arrangement enables the shoe 2 to be inserted into, or removed from, the footwear element 1. Consequently, the aforementioned arrangement enables the foot to be inserted or removed at the same time as the shoe.

The footwear element 1 also comprises a device 28 for closing the lower subdivision 27 of the shoe insertion opening 25. This keeps the upper 4 in contact with the shoe 2, on the one hand, and in contact with the ankle and the lower leg, on the other part.

In a non-limiting fashion, the closure device 28 includes a slide fastener 29, such as a zipper, which provides for a quick opening or closure of the lower subdivision 27, thereby enabling the shoe be inserted or removed more quickly. However, other structures, such as a lace device, a device with complementary bands, one of which is provided with loops and the other with hooks, or any equivalent, such as Velcro® fasteners, are possible for the closure device.

Still according to the first embodiment of the invention, the lower subdivision 27 of the shoe insertion opening 25 is arranged at the rear of the upper. This makes it easier to insert a foot already covered by the shoe into the footwear element 1. Another advantage is improved resistance to penetration of foreign material, especially in snowy environments. Indeed, because the lower subdivision 27 is located at the rear, the front surface 30 of the upper 4 is continuous from the front end 6 to the upper end 21. In other words, the front surface has no passage. However, walking involves forward movements and contacts of the upper 4 with snow on the side of this surface. That is, as shown in FIGS. 1, 2, and 4, for example, the continuity of the upper extends from the front and more than 50% of the way around each of the sides toward the rearmost end of the upper. The structural continuity of the upper guarantees imperviousness and/or protection.

The footwear element 1 also comprises tightening devices 31, 32, 33 for tightening the upper 4. The tightening devices include straps, such as, for example, a front strap 31, located in the area of the metatarsus, a lower rear strap 32, located in the area of the instep, and an upper rear strap 33, located in the area of the upper end 21. Each strap can be tightened or loosened in order to adjust the volume of the footwear element 1. It is thus possible to press the footwear element 1 more efficiently on the shoe 2 and on the lower leg. This results in a more precise application of the outer sole assembly 3 of the footwear element 1 against the outer sole assembly 13 of the shoe 2. Consequently, the stability of the spikes 9 is increased and the transmission of impulse forces or sensory information related to walking or running is more accurate. The perception of proprioceptive information is increased.

The outer sole assembly 3 of the footwear element 1 is flexible, in the sense that it allows bending or a rolling movement of the foot during walking, as is understood with reference to FIG. 4. The outer sole assembly 3 comprises one or more layers of synthetic material, for example. In a non-limiting fashion, a layer of material such as polyurethane, whose thickness is between 3.0 mm and 7.0 mm, can be provided.

As can be seen in each of FIGS. 1 to 4, according to the first embodiment, the footwear element 1 comprises a rear crampon 41 and a front crampon 42. The rear crampon 41 is located in the area of the heel, in the vicinity of the rear end 5, whereas the front crampon 42 is located in the area of the toes and of the metatarsus, in the vicinity of the front end 6. This preserves an intermediate surface of the outer sole assembly 3 between the spikes: this surface is free. That is, there are no spikes projecting from the intermediate surface. As a result, the outer sole assembly 3, and therefore the entire footwear element 1, retains good ability to bending or rolling movement, thereby making it easier to walk or run.

The rear crampon 41 includes a body 43 and spikes 9, and the front crampon 42 includes a body 44 and spikes 9. In the illustrated first embodiment, shown in FIG. 1, four spikes 9 are shown projecting from the body of each of the bodies of the front and rear crampons, two proximate the lateral side of the footwear element and two proximate the medial side. More generally, each crampon 41, 42 includes a body 43, 44 arranged on the side of the outer surface 10 of the outer sole assembly 3. This facilitates the manufacture of the footwear element 1, in the sense that the crampons are easily positioned on the outer sole assembly 3.

In a non-limiting fashion, the footwear element 1 comprises fasteners 45 for the permanent attachment of each crampon 41, 42 to the outer sole assembly 3. These fasteners comprise, for example, rivets 45 which maintain each body 43, 44 in contact with the outer surface 10 of the outer sole assembly 3. This allows for a simple and economical manufacture, and an irremovable connection between the crampons and the remainder of the footwear element. Consequently, the user does not waste time in associating the crampons with the sole assembly in order to use the footwear element. The aforementioned permanent attachment can be considered as an irremovable connection. As can be seen in FIGS. 1 and 2, for example, the body of the crampon and the spikes, such as the body 44 and spikes 9 of front crampon 42 (shown in cross section in FIG. 2) are fixed against movement in relation to at least a portion of the outer sole assembly directly beneath the body of the crampon. Alternatively, a removable connection carried out with or without tools, that it to say, via screw fastening or snap fastening, for example, can be provided.

The front crampon 42 comprises, in a non-limiting fashion, a transverse articulation 46 which connects two subdivisions 47, 48 of the body 44 to one another. More specifically, the crampon 42 comprises a rear subdivision 47 and a front subdivision 48, the subdivisions being articulated in relation to one another. This enables the body to follow the bending deformations of the outer sole assembly 3 at the front of the footwear element 1. The articulation is comprised of a pair of bent hooks of the rear subdivision that extend through respective slots of the front subdivision. Other structures can be used for enabling movement between the front and rear subdivisions.

The other embodiments are described below with reference to FIGS. 5-8. For reasons of convenience, the elements that are shared with the first embodiment are designated by the same reference numerals.

Figure 5:
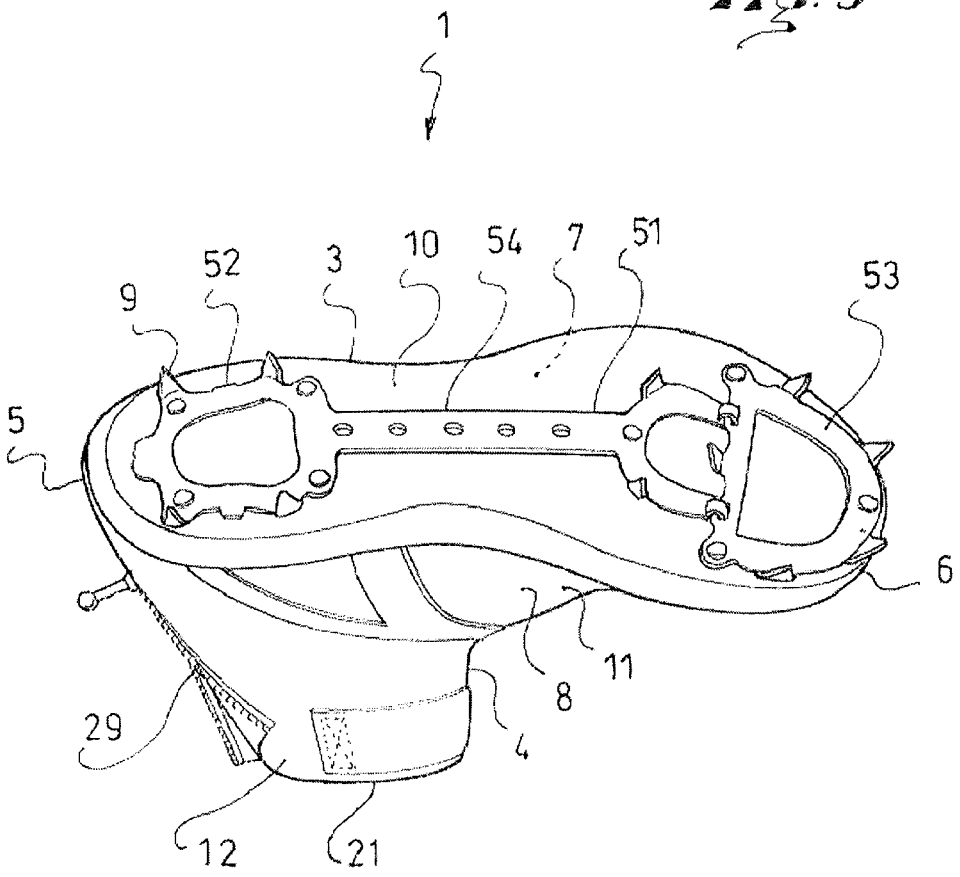
FIG. 5 is similar to FIG. 2, for a second embodiment of the invention.

The second embodiment, according to FIG. 5, features a footwear element 1 having an outer sole assembly 3 and a flexible upper 4.

What is specific to the second embodiment is that the footwear element 1 comprises a single crampon 51 extending along a length between 70% and 100% of the length of the outer sole assembly 3 and, for example, comprising a rear subdivision 52 and a front subdivision 53, both provided with spikes 9, as well as a bridge 54 connecting the subdivisions to one another. This single crampon 51 rigidifies the outer sole assembly 3, thereby providing the sole assembly with a certain torsional strength about a longitudinal axis of the footwear element and/or a certain flexional strength about a transverse axis of the footwear element. The second embodiment corresponds to a footwear element that is well-suited for moving on ice.

Figure 6:
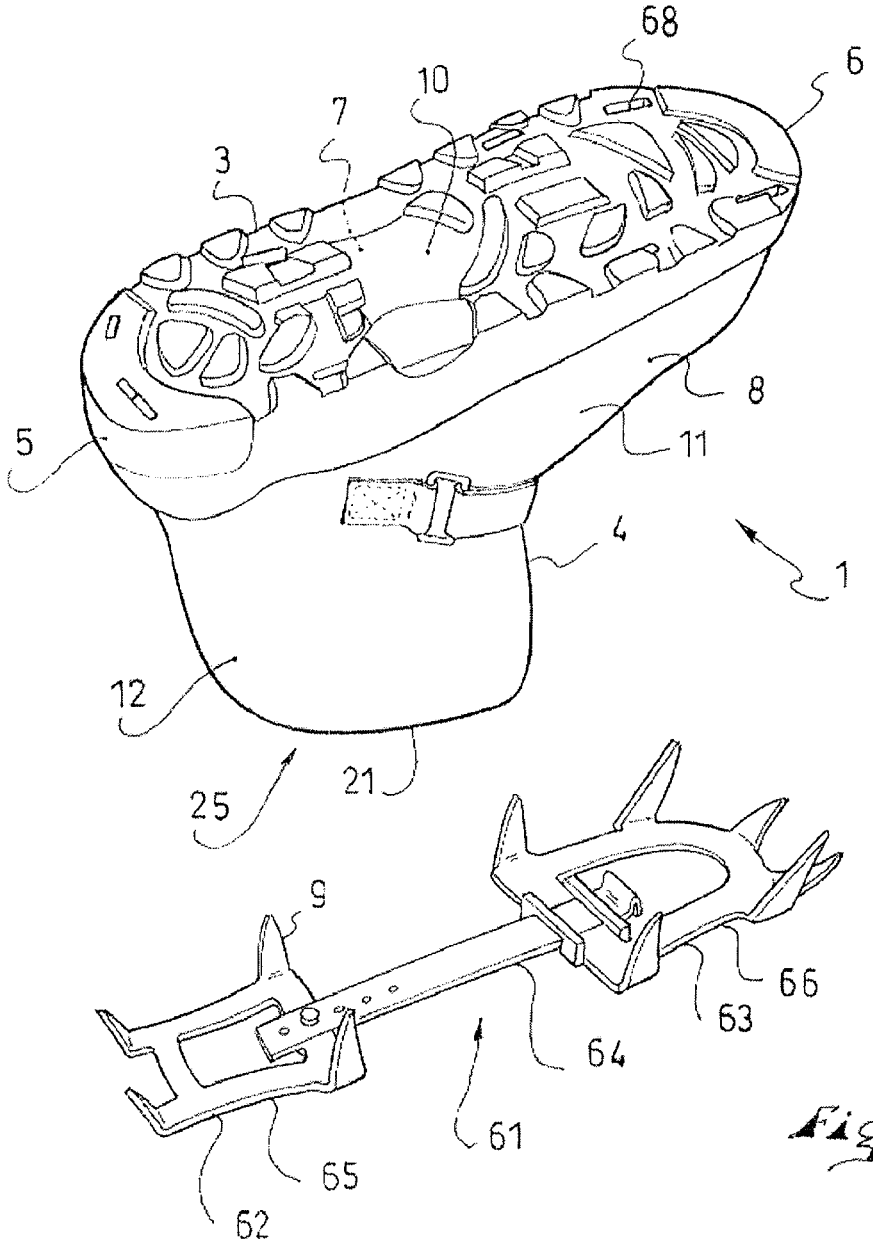
FIG. 6 is a perspective bottom view of a footwear element according to a third embodiment of the invention, in a case in which the spikes are separated from the outer sole assembly.
Figure 7:
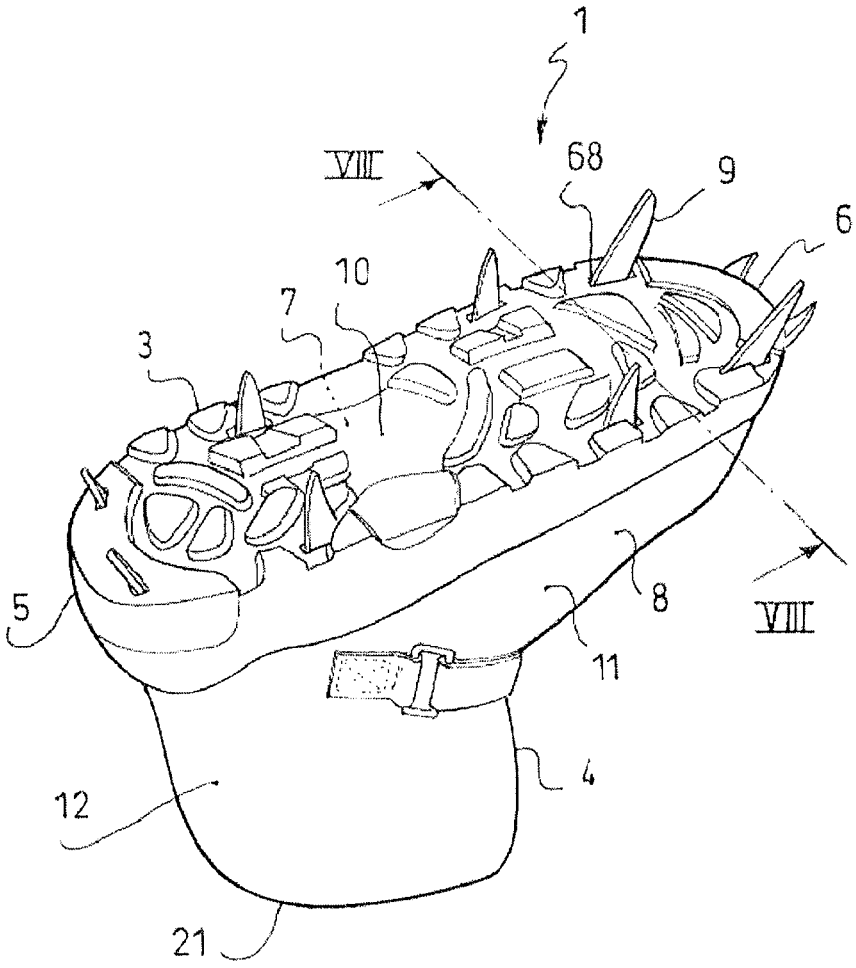
FIG. 7 is similar to FIG. 6, in a case in which the spikes are connected to the outer sole assembly.
Figure 8:
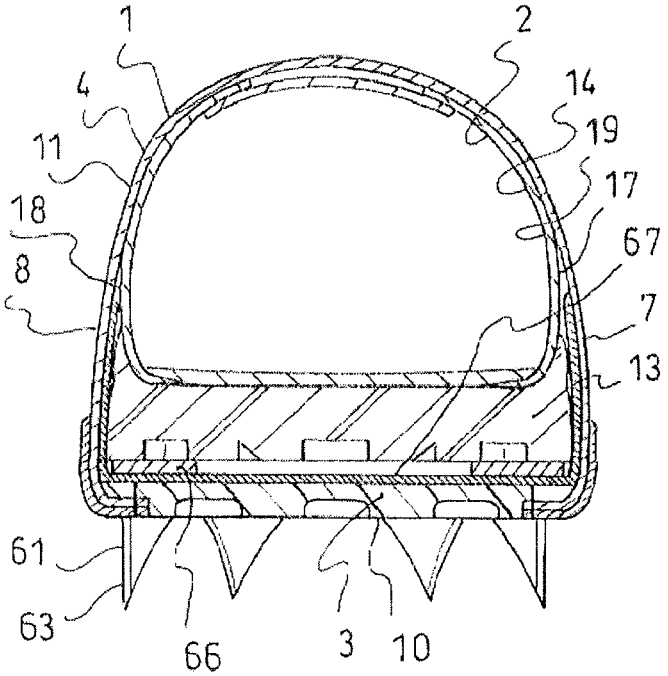
FIG. 8 is a cross-section along the line VIII-VIII of FIG. 7.

The third embodiment according to FIGS. 6-8 also features a footwear element 1 having an outer sole external 3 and a flexible upper 4. The footwear element 1 also comprises a crampon 61, which itself comprises a rear subdivision 62 and a front subdivision 63, both provided with spikes 9, as well as a bridge 64 connecting the subdivisions to one another. Without it being required, the crampon 61 is adjustable lengthwise, which enables it to be used for footwear elements of various sizes.

What is specific to the third embodiment is that each crampon 61 comprises a body 65, 66 arranged on the side of an inner surface 67 of the outer sole assembly 3. More specifically, the rear subdivision 62 of the crampon 61 comprises a body 65, and the front subdivision 63 comprises a body 66. The inner surface of the outer sole assembly 3 is opposite the outer surface 10 and, as a result, is turned toward the shoe 2 when the latter is housed in the footwear element 1. The spikes 9 project in relation to the outer surface 10, extending through the thickness of the outer sole assembly 3 from the inner surface 67. Openings 68 conforming to the shapes of the spikes 9 are provided for this purpose. In fact, the crampon 61 is positioned by being inserted within the footwear element 1, with the spikes oriented toward the outer sole assembly 3. A push, for example by hand, causes the spikes 9 to extend through the sole assembly 3 via the openings 68. Then, during use, the shoe 2 keeps the crampon(s) in place. Each body 65, 66 is then held between the outer sole assembly 3 of the footwear element and the outer sole assembly 13 of the shoe 2. This arrangement enables an easy removal of the footwear element 1.

In any case, the invention is made from materials and using techniques of implementation known to one of ordinary skill in the art.

The invention is not limited to the embodiments described above, and includes all technical equivalents that fall within the scope of the claims that follow.

In particular, the invention covers an assembly comprising a low-upper shoe 2 and a footwear element 1. By low-upper is meant a shoe whose upper edge of the foot opening extends below or at the heel, i.e., not a high-upper which extends upwardly beyond the heel.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A footwear element configured to removably receive a low-upper shoe within the footwear element, the shoe having an outer sole and an upper, the footwear element comprising:

an outer sole assembly comprising an outer surface;

the outer sole assembly being flexible, allowing the foot to flex during walking and running;

a flexible upper extending upwardly from the outer sole assembly;

at least one crampon, each of the at least one crampon comprising a body and a plurality of spikes projecting from the body in a direction outwardly away from the outer surface of the outer sole assembly;

permanent attachment fasteners permanently attaching the at least one crampon to the outer sole assembly; and the flexible upper comprising:

a lower portion configured to cover a foot of a wearer;

an upper portion extending from the lower portion in a direction away from the outer sole assembly, the upper portion being configured to cover at least an ankle of the wearer, or the ankle and a portion of a lower leg of the wearer; and a shoe insertion opening configured to receive the shoe of the wearer.

2. The footwear element according to claim 1, wherein: the lower portion and the upper portion form a continuous envelope for the shoe.

3. The footwear element according to claim 2, wherein: the continuous envelope of the lower and upper portions of the upper has no passage for entry of water through a front surface of the upper from a front end to an upper end and from the front surface of the upper and more than 50% around each of medial and lateral sides in a direction toward a rearmost end of the upper.

4. The footwear element according to claim 1, wherein: the shoe insertion opening of the upper has a lower subdivision structured and arranged to enable the size of the shoe insertion opening and the size of the fitting volume to be varied; and the footwear element further comprising a device to selectively open and close the lower subdivision of the shoe insertion opening.

5. The footwear element according to claim 4, wherein: the device comprises a slide fastener.

6. The footwear element according to claim 4, wherein: the lower subdivision of the opening is positioned at the rear of the upper.

7. The footwear element according to claim 1, wherein: the at least one crampon comprises a rear crampon and a front crampon.

8. The footwear element according to claim 1, further comprising wherein:

the at least one crampon consists of only a single crampon.

9. The footwear element according to claim 8, wherein: the crampon comprises a rear subdivision and a front subdivision, the subdivisions being articulated relative to one another.

10. The footwear element according to claim 1, wherein: each of the at least one crampon comprises a body positioned on a side of the outer surface of the outer sole assembly.

11. The footwear element according to claim 1, wherein: the permanent attachment fasteners are rivets.

12. The footwear element according to claim 1, further comprising:

a tightening device positioned on the flexible upper and extending at least downwardly at least to a metatarsus area of the outer sole assembly, the tightening device designed to tighten the upper onto a wearer's foot positioned within the upper.

13. The footwear element according to claim 12, wherein: the tightening device comprises straps.

14. The footwear element according to claim 1, wherein: the at least one crampon comprises a rear subdivision and a front subdivision; and an articulation connecting the front and rear subdivisions to be articulated in relation to each another.

15. The footwear element according to claim 1, wherein: the at least one crampon comprises four spikes connected to the body.

16. The footwear element according to claim 1, wherein: each of the at least one crampon comprises a body positioned either below the outer sole assembly or above the outer sole assembly.

17. The footwear element according to claim 16, wherein: the body of the crampon is fixed against movement in relation to at least a portion of the outer sole assembly directly beneath the body of the crampon.

18. The footwear element according to claim 16, wherein: the body of the crampon and the plurality of spikes are fixed against movement in relation to at least a portion of the outer sole assembly directly beneath the body of the crampon.

19. The footwear element according to claim 1, wherein: the permanent attachment fasteners are permanently attached to the body of the at least one crampon.

20. The footwear element according to claim 1, wherein: the permanent attachment fasteners provide an irremovable connection between the at least one crampon, including the body and the plurality of spikes, to the outer sole assembly.

21. An assembly comprising:

a low-upper shoe configured to be worn by a wearer, the shoe having an outer sole and an upper; and a footwear element to removably receive the low-upper shoe within the footwear element, the low-upper shoe having an outer sole and an upper, the footwear element comprising:

an outer sole assembly comprising an outer surface;

the outer sole assembly being flexible, allowing the foot to flex during walking and running;

a flexible upper extending upwardly from the outer sole assembly;

at least one crampon, each of the at least one crampon comprising a body and a plurality of spikes projecting from the body in a direction outwardly away from the outer surface of the outer sole assembly;

permanent attachment fasteners permanently attaching the at least one crampon to the outer sole assembly of the footwear element; and the flexible upper comprising:

a lower portion configured to cover a foot of wearer;

an upper portion extending from the lower portion in a direction away from the outer sole assembly, the upper portion being configured to cover at least an ankle of the wearer, or the ankle and a portion of a lower leg of the wearer; and a shoe insertion opening configured to receive the low-upper shoe when worn by the wearer.

22. The footwear element according to claim 1, further comprising:

a tightening device comprising an instep strap extending around an instep of the upper and downwardly to a heel area of the outer sole assembly.

23. The footwear element according to claim 22, wherein:

the tightening device further comprises an upper rear strap extending at least partially around the upper portion of the upper.

24. The assembly according to claim 21, wherein:

the lower portion and the upper portion of the upper form a continuous envelope for the shoe; and the continuous envelope has no passage for entry of water through a front surface of the upper from a front end to an upper end and from the front surface of the upper and more than 50% around each of medial and lateral sides in a direction toward a rearmost end of the upper.

25. The assembly element according to claim 21, wherein:

the permanent attachment fasteners are rivets.

26. The assembly according to claim 21, further comprising:

a tightening device positioned on the flexible upper and extending at least downwardly at least to a metatarsus area of the outer sole assembly, the tightening device designed to tighten the upper onto a wearer's foot positioned within the upper.

27. The assembly according to claim 21, wherein:

the permanent attachment fasteners are permanently attached to the body of the at least one crampon.

28. The assembly according to claim 27, wherein:

the body of the crampon is fixed against movement in relation to at least a portion of the outer sole assembly directly beneath the body of the crampon.

* * * * *